US006137214A

United States Patent [19]

Raina

[11] Patent Number: 6,137,214

[45] Date of Patent: Oct. 24, 2000

[54] DISPLAY DEVICE WITH SILICON-CONTAINING ADHESION LAYER

[75] Inventor: Kanwal K. Raina, Boise, Id.

[73] Assignee: Micron Technology, Inc., Boise, Id.

[21] Appl. No.: 09/431,015

[22] Filed: Nov. 1, 1999

Related U.S. Application Data

[62] Division of application No. 09/027,528, Feb. 23, 1998, Pat. No. 6,064,149.

[51] Int. Cl.[7] ..... H01J 1/02

[52] U.S. Cl. ..... 313/309; 313/351; 313/336; 313/495; 313/497

[58] Field of Search ..... 313/309, 311, 313/336, 351, 293, 296, 495, 496, 497

[56] References Cited

U.S. PATENT DOCUMENTS

| | | | |
|---|---|---|---|
| 5,229,331 | 7/1993 | Doan et al. | 437/228 |
| 5,371,431 | 12/1994 | Jones et al. | 313/309 |
| 5,372,973 | 12/1994 | Doan et al. | 437/228 |
| 5,448,131 | 9/1995 | Taylor et al. | 313/309 |
| 5,521,461 | 5/1996 | Garcia | 313/336 |
| 5,525,857 | 6/1996 | Gnade et al. | 313/309 |
| 5,534,743 | 7/1996 | Jones et al. | 313/309 |
| 5,789,857 | 8/1998 | Yamaura et al. | 313/495 |

OTHER PUBLICATIONS

Fluckiger et al., "Structural and Electrical Properties of Undoped Microcrystalline SIlicon Grown by 70 MHz and 13.56 MHz PECVD," Mat. Res. Soc. Symp. Proc., vol. 358, pp. 751–756 (1995).

He et al., "Low Temperature Plasma–Assisted Deposition Process for Microcrystalline Thin Film Transistors, TFTS," Mat. Res. Soc. Symp. Proc., vol. 345, pp. 53–58 (1994).

He et al., "Low Temperature Plasma–Assisted Deposition Process for Microcrystalline Thin Film Transistors, TFTS," Mat. Res. Soc. Symp. Proc., vol. 336, pp. 25–30 (1994).

Mireshghi et al., "Improved Electrical and Transport Characteristics of Amorphous Silicon by Enriching with Microcrystalline Cellulose," Mat. Res. Soc. Symp. Proc., vol. 336, pp. 337–382 (1994).

Shirai, "Surface Morphology and Crystallite Size during Growth of Hydrogenated Microcrystalline Silicon by Plasma–Enhanced Chemical Vapor Deposition," Jpn. J. Appl. Phys., vol. 34, pp. 450–458 (1995).

*Primary Examiner*—Nimeshkumar D. Patel
*Assistant Examiner*—Mariceli Santiago
*Attorney, Agent, or Firm*—Workman, Nydegger & Seeley

[57] ABSTRACT

A field emission device having a gate electrode structure in which a nanocrystalline or microcrystalline silicon layer is positioned over a silicon dioxide dielectric layer. Also disclosed are methods for forming the field emission device. The nanocrystalline or microcrystalline silicon layer forms a bond with the dielectric layer that is sufficiently strong to prevent delamination during a chemical-mechanical planarization operation that is conducted during formation of the field emission device. The nanocrystalline or microcrystalline silicon layer is deposited by PECVD in an atmosphere that contains silane and hydrogen at a ratio in a range from about 1:15 to about 1:40. Multiple field emission devices may be formed and included in a flat panel display for computer monitors, telecommunications devices, and the like.

26 Claims, 4 Drawing Sheets

DISPLAY DEVICE WITH SILICON-CONTAINING ADHESION LAYER

RELATED APPLICATIONS

This application is a divisional application of United States patent application Ser. No. 09/027,528, filed on Feb. 23, 1998 is now 6,064,149, which is incorporated herein by reference.

GOVERNMENT INTEREST

This invention was made with Government support under Contract No. DABT63-97-C-0001 awarded by Advanced Research Projects Agency (ARPA). The Government has certain rights in this invention.

BACKGROUND OF THE INVENTION

1. The Field of the Invention

The present invention relates to field emission devices. More particularly, the present invention relates to a field emission device having a gate electrode including a layer of nanocrystalline or microcrystalline silicon that provides improved adhesion with an underlying silicon dioxide layer. The invention is also directed to methods of making and using the field emission device.

2. The Relevant Technology

Integrated circuits and related structures are currently manufactured by an elaborate process in which semiconductor devices, insulating films, and patterned conducting films are sequentially constructed in a predetermined arrangement on a semiconductor substrate. In the context of this document, the term "semiconductor substrate" is defined to mean any construction comprising semiconductive material, including but not limited to bulk semiconductive material such as a semiconductive wafer, either alone or in assemblies comprising other materials thereon, and semiconductive material layers, either alone or in assemblies comprising other materials. The term "substrate" refers to any supporting structure including but not limited to the semiconductor substrates described above. The term semiconductor substrate is contemplated to include such structures as silicon-on-insulator and silicon-on-sapphire.

Computer monitors, televisions, and other visual display devices have traditionally used cathode ray tubes which use an electron gun to direct a scanning electron beam upon a phospholuminescent screen. With the advent of portable personal computers, telecommunication devices, and other such appliances, there has been an increased interest in high quality lightweight display panels that are not as bulky as cathode ray tubes. A promising and useful development has been the incorporation of field emission devices into integrated circuits, semiconductor structures or related products to produce flat panel displays.

A field emission device typically includes an electron emission structure or tip configured for emitting a flux of electrons upon application of an electric field thereto. The emitted electrons may be directed to a transparent panel having phospholuminescent material placed thereon. By selecting and controlling the operation of an array of miniaturized field emission devices, a selected visual display that is suitable for use in computer and other visual and graphical applications may be produced. Flat panel displays using field emission devices typically have a greatly reduced thickness compared to cathode ray tubes. As a result, field emission devices have been shown to be an attractive alternative to cathode ray tube display devices.

Field emission devices used in flat panel displays are generally multilayer structures formed over a semiconductor, glass, or other substrate. FIG. 1 illustrates an example of a field emission device in an intermediate step during the manufacturing process. Multilayer structure 10 comprises two structures that will be used as electrodes during operation of the completed field emission device. In particular, cathode structure 12 and low potential gate electrode structure 14 will be used to establish an electric field across electron emission structure 16. The two electrodes are separated by a dielectric layer 18.

In order to freely emit a flow of electrons, electron emission structure 16 must be exposed during manufacturing by removing material positioned thereon. One of the steps of exposing electron emission structure 16 may include conducting a planarization operation on multilayer structure 10, including a layer 21, by chemical-mechanical planarization or other mechanical or non-mechanical means, thereby producing a substantially planar surface indicated by the dashed line at 20. Layer 21 comprises a conductive material such as chromium, aluminum, alloys thereof, and/or silicon.

When chemical-mechanical planarization is used to expose electron emission structure 16, there is the risk of delamination of layer 21 from dielectric layer 18 if the bonding forces therebetween are not sufficiently strong. Typically, it has been understood that the bonding forces between a silicon dioxide substrate and an overlying silicon layer are related to the internal compressive stress of the overlying silicon layer. Generally, higher compressive stress values tend to correlate with poor bonding and increased risk of delamination. While not a fixed rule, it has been observed in the past that compressive stress less than $2\times10^9$ dynes/$cm^2$ are preferred in some circumstances in order to reduce the tendency of the layers to delaminate.

Nonetheless, an amorphous silicon layer deposited on a silicon dioxide layer using plasma-enhanced chemical vapor deposition (PECVD) frequently delaminates during a subsequent chemical-mechanical planarization operation, even though the compressive stress of the amorphous silicon layer may be relatively low. The difficulties involved in forming an adequate bond between an amorphous silicon layer deposited using PECVD and a silicon dioxide substrate have generally discouraged the use of PECVD amorphous silicon layers when chemical-mechanical planarization steps are to be conducted thereon. As a result, when chemical-mechanical planarization has been used in the prior art, layer 21 has generally consisted of materials other than amorphous silicon.

However, in general, amorphous silicon is understood to be a preferred material in forming other portions of field emission devices and other semiconductor structures. Moreover, PECVD is a preferred and efficient method for depositing silicon layers over a substrate. The inability to use PECVD amorphous silicon layers as described above when chemical-mechanical planarization operations are subsequently conducted has been a persistent problem that, if overcome, would significantly improve the cost-effectiveness and reliability of the process of manufacturing field emission devices.

In view of the foregoing, it is clear that there is a need for methods of manufacturing field emission devices in which a silicon layer may be deposited by PECVD on a dielectric layer without delaminating during subsequent chemical-mechanical planarization. In particular, it would be an advancement in the art to provide a method for depositing silicon on silicon dioxide to produce a bond sufficiently strong tot resist subsequent delamination in the fabrication of a field emission device.

SUMMARY OF THE INVENTION

The present invention relates to a field emission device having a gate electrode structure that includes a silicon adhesion layer of nanocrystalline or microcrystalline silicon which provides improved adhesion with an underlying layer of silicon dioxide. The invention also includes methods of making and using the field emission device. According to the invention, mechanical planarization may be conducted during the manufacturing process without causing the gate electrode structure to delaminate.

The method of the invention includes forming one or more electron emission structures over a cathode structure and a substrate. A silicon dioxide dielectric layer is conformally deposited over the electron emission structures. A silicon adhesion layer is then formed on the silicon dioxide dielectric layer by plasma-enhanced chemical vapor deposition in an atmosphere of silane and hydrogen at a ratio in a range from about 1:15 to about 1:40. The silicon of the silicon adhesion layer has a nanocrystalline or microcrystalline structure in which the mean grain size is in a range from about 200 Å to about 1,000 Å. Preferably, the silicon of the silicon adhesion layer is undoped or is doped at a dopant concentration not in excess of about $10^{21}$ atoms/$cm^3$. A layer of amorphous silicon, which may be phosphorous-doped, is preferably next deposited on the silicon adhesion layer.

Chemical-mechanical planarization or another mechanical or non-mechanical planarization operation is then conducted to form a substantially planar surface over the electron emission structures. It has been found that the silicon adhesion layer of the invention forms an adequate bond with the silicon dioxide dielectric layer such that delamination does not occur during the chemical-mechanical planarization operation. This result would have been particularly unexpected at the time this invention was made, because it has been observed by the inventor that positioning the silicon adhesion layer between the silicon dioxide layer and the overlying amorphous silicon layer tends to increase the compressive stress of the silicon adhesion layer and the amorphous silicon layer. As has been noted, it was previously believed that an increase in compressive stress was correlated with an increase in the risk of delamination.

After planarization, a metal layer may be deposited and patterned to become part of the gate electrode structure. An isotropic etch is applied to the silicon dioxide dielectric layer to form an aperture that exposes the electron emission structure. An anode plate containing phospholuminescent material is positioned over and separated from the gate electrode structure. During operation of the field emission device, electrons emitted from the electron emission structure accelerate toward the anode plate, strike the phospholuminescent material, and cause light to be emitted therefrom.

A flat panel display may be produced by manufacturing an array of field emission devices according to the invention. Operation of individual field emission devices may be coordinated to produce a selected visual display upon the flat panel display.

In view of the foregoing, the present invention provides methods of forming field emission devices in which the gate electrode includes a silicon adhesion layer deposited on an underlying silicon dioxide dielectric layer without the risk of delamination during subsequent chemical-mechanical planarization. The invention enhances the usefulness of chemical-mechanical planarization and other mechanical planarization operations in relation to formation of field emission devices and flat panel displays. This is particularly important, because it has been found that chemical-mechanical planarization allows formation of flat panel displays that are significantly larger than those available through other methods.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

The present invention relates to field emission devices having a gate electrode structure in which a nanocrystalline or microcrystalline silicon adhesion layer is deposited on an underlying silicon dioxide dielectric layer. The nanocrystalline or microcrystalline silicon adhesion layer forms a bond with the silicon dioxide dielectric layer that is sufficiently strong to resist delamination during chemical-mechanical planarization processes that are conducted during manufacturing. The invention disclosed herein also includes methods of making and using the field emission devices.

The term "field emission device", as used in the specification and the appended claims, refers to any construction for emitting electrons in the presence of an electrical field, including but not limited to an electron emission structure or tip either alone or in assemblies comprising other materials or structures. "Electron emission apparatus" refers to one or more field emission devices or any structure or product including one or more field emission devices.

The term "mechanical planarization", as used in the specification and the appended claims, refers to formation of substantially planar surfaces on a structure or other removal of material from a structure along a substantially planar boundary in an operation conducted through mechanical action, abrasion, or other mechanical removal of material. "Chemical-mechanical planarization", which is a subset of "mechanical planarization", shall refer to planarization operations in which a slurry having a chemically active component and an abrasive component are used in conjunction with a polishing element, such as a polishing pad. It will be understood that, although chemical-mechanical planarization is presented herein as an exemplary form of planarization, the invention should not be seen as being limited thereto. Instead, the invention is expressly intended to extend to other mechanical and non-mechanical planarization operations.

The term "nanocrystalline", as used in the specification and the appended claims, shall refer to a grain structure or crystalline structure of a material in which the mean grain size of the material is in the range from 200 Å to 500 Å. The term "microcrystalline", as used in the specification and the appended claims, shall refer to a grain structure or crystalline structure of a material in which the mean grain size in the range from 500 Å to about 1,000 Å. In contrast, amorphous silicon is generally understood to include silicon having no definite crystalline or grain structure, or which has a mean grain size that is less than 200 Å.

Figure 1:
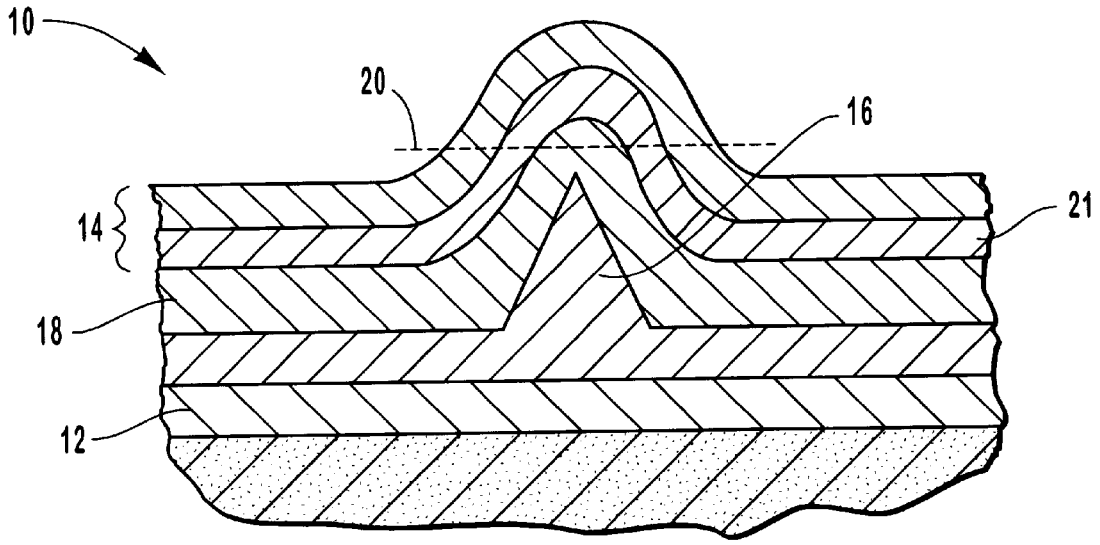
FIG. 1 (PRIOR ART)
FIG. 1 is a partial cross-section elevation view of a multilayer structure during an intermediate step of a process for producing a field emission device as practiced in the prior art.
Figure 2:
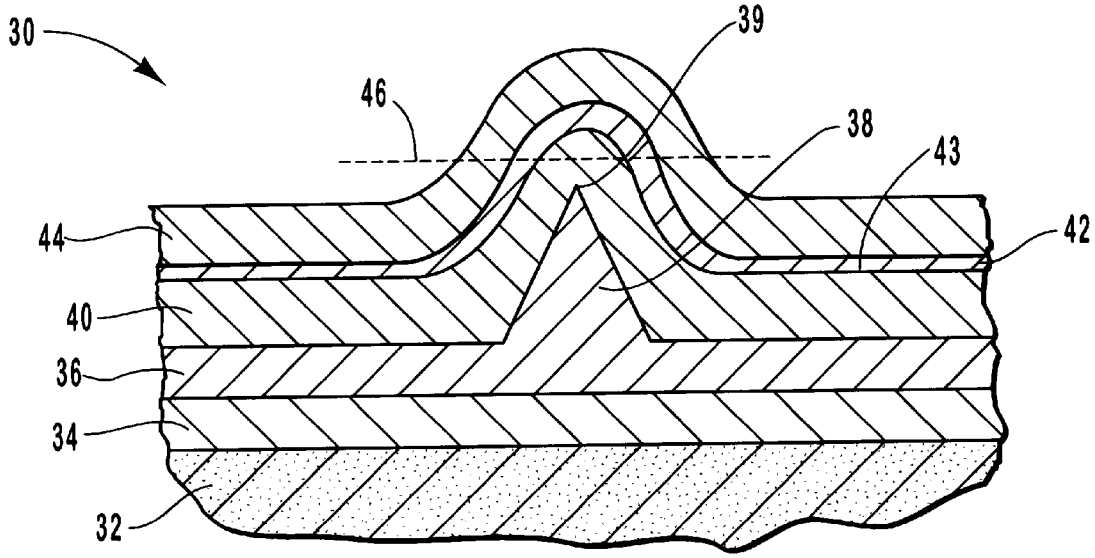
FIG. 2 is a partial cross-section elevation view of a multilayer structure according to the present invention. The multilayer structure includes a substrate, a cathode structure, an electron emission structure, a silicon dioxide dielectric layer, and a partially formed gate electrode structure. The gate electrode structure includes a nanocrystalline or microcrystalline silicon layer deposited over the silicon dioxide dielectric layer.

FIG. 2 illustrates a multilayer structure 30 having undergone several initial steps in the process of forming a field emission device according to a preferred embodiment of the invention. A substrate 32 is provided, and may be a glass layer, a silicon substrate, or other suitable structure. Indeed, substrate 32 may be any desired substrate on which a field emission device may be assembled. Soda-lime glass, which is characterized by durability, relatively low softening and melting temperatures, and low cost, is a preferred material for substrate 32. Soda-lime glass, as used herein, includes, but is not limited to, compositions comprising silica ($SiO_2$), sodium oxide ($Na_2O$), calcium oxide (CaO) and, optionally, oxides of aluminum, magnesium, iron, tin, and/or potassium. Soda-lime glass as used herein also extends to such compositions in which sodium oxide is replaced by oxides of potassium.

By way of example, one suitable composition of soda-lime glass includes silica at a concentration in a range from about 72% to about 73%, sodium oxide and/or potassium oxide ($K_2O$) at a concentration in a range from about 13% to 14%, calcium oxide in a range from about 7.7% to about 8.5%, aluminum oxide ($Al_2O_3$) in a range from about 0.5% to about 1.5%, magnesium oxide (MgO) in a range from about 3.4% to about 4.5%, and iron oxide ($Fe_2O_3$) in a range from about 0.08% to about 0.12%.

Although substrate 32 is generally electrically insulative, there is optionally formed thereon a silica layer or another insulative layer to limit diffusion of impurities from substrate 32 into overlying layers and to facilitate adhesion of overlying layers. Furthermore, the optional insulative layer may prevent leakage of current and charge between substrate 32 and conductive structures situated thereon.

A cathode structure and an electron emission structure are then formed over the substrate. It will be understood that the present invention may be practiced with any suitable cathode structure and any suitable electron emission structure. A favored example of a suitable cathode structure is seen in FIG. 2. Cathode conductive layer 34 may be formed upon substrate 32 by physical vapor deposition and may comprise, but is not limited to, chromium, aluminum, or alloys thereof. Cathode conductive layer 34 will function as the cathode of the completed field emission device.

It is preferred to form an electrically resistive layer 36 over cathode conductive layer 34. For example, electrically resistive layer 36 may be a boron-doped amorphous silicon layer deposited through PECVD in an atmosphere of a mixture of silane and diborane. Preferably, this PECVD is conducted at relatively love temperature, for example, less than about 400° C., which ensures that soda-lime glass used in substrate 32 will not soften or melt. The invention is not limited to the particular electrically resistive layer 36 disclosed herein, and may be practiced in the absence of an electrically resistive layer.

Electron emission structure 38, comprising phosphorous-doped amorphous silicon, is presented as but one example of a suitable electron emission structure. Electron emission structure 38 may be constructed by forming a phosphorous-doped amorphous silicon layer, by PECVD or otherwise, over the underlying layers. The phosphorus-doped amorphous silicon layer is then patterned by an etching process, for example, to form therefrom a conical structure that projects away from substrate 32. It is understood in the art that an electron emission structure functions most efficiently when it tapers to a relatively sharp apex, such as apex 39. Preferred alternative materials for electron emission structure 38 are those that have a relatively low work function, so that a low applied voltage will induce a relatively high electron flow therefrom.

Dielectric layer 40, preferably composed of silicon dioxide, is formed over electrically resistive layer 36 and electron emission structure 38. Dielectric layer 40 is preferably formed by PECVD in an atmosphere of silane and nitrous oxide. Dielectric layer 40 electrically separates the underlying cathode structure from the gate electrode structure that is to be formed on dielectric layer 40.

Next, the gate electrode structure, which is otherwise known as the grid, is formed on dielectric layer 40. Prior to the present invention, if a silicon layer were to be formed directly on dielectric layer 40 as part of the gate electrode structure, the silicon layer would readily delaminate during subsequent planarization processes.

Under the present invention, it has been discovered that adequate adhesion may be achieved between a silicon layer and an underlying silicon dioxide layer by conducting PECVD of silicon according to the conditions disclosed herein. For example, a silicon adhesion layer 42 composed of undoped silicon is deposited directly upon dielectric layer 40 by conducting PECVD in an atmosphere of silane and hydrogen in a ratio in a range from about 1:15 to about 1:40, preferably using a deposition chamber operating at a frequency in a range from about 13 MHz to about 67 MHz.

The deposited undoped silicon preferably has a mean grain size in a range from about 200 Å to about 1,000 Å. Accordingly, silicon adhesion layer 42 has a grain structure that is nanocrystalline or microcrystalline. Alternatively, silicon adhesion layer 42 may consist of nanocrystalline or microcrystalline silicon that is doped instead of undoped. In the case where the nanocrystalline or microcrystalline silicon is doped, the dopant concentration is preferably no greater than about $10^{21}$ atoms/$cm^3$. Boron and phosphorus are examples of dopants that may be used according to the invention. Silicon adhesion layer 42 is deposited to a depth that is preferably in a range from about 500 Å to about 1,500 Å. In one successful PECVD operation that is presented by way of example, and not by limitation, hydrogen was introduced at a rate of about 4,500 sccm and silane was introduced at a rate of about 200 sccm.

Before the present invention was made, it had generally been understood that an increase in the compressive stress of a silicon layer tended to decrease the bonding forces between the silicon layer and a silicon dioxide substrate and to increase the likelihood of delamination. Contrary to this conventional wisdom, forming the silicon adhesion layer 42 of the invention between dielectric layer 40 and a subsequently-formed amorphous silicon layer has been observed to increase the compressive stress of the silicon adhesion layer and the amorphous silicon layer.

For example, experiments have shown that the compressive stress in a silicon adhesion layer having a thickness of about 1,500 Å and an amorphous silicon layer having a thickness of about 6,000 Å formed according to the invention is in a range from about $4\times10^9$ dynes/cm$^2$ to about $5\times10^9$ dynes/cm$^2$. These values are significantly greater than that which was conventionally preferred prior to the invention. Moreover, in some structures formed according to the invention, the compressive stresses may be as high as $9\times10^9$ dynes/cm$^2$ or greater.

While the inventor does not wish to be bound to a single theory to explain the improved adhesion, it is currently believed that the growth mechanism of the silicon adhesion layer 42 may promote adhesion between it and silicon dioxide layer 40. In particular, the inclusion of $H_2$ in the PECVD process is believed to facilitate the observed adhesive properties of the structures of the invention.

Under the invention, it has been found that silicon adhesion layer 42 withstands delamination from dielectric layer 40 during subsequent chemical-mechanical planarization and other mechanical and non-mechanical planarization operations. In particular, the bond between silicon adhesion layer 42 and dielectric layer 40 remains generally intact along substantially all of interface 43. It will be understood that "interface" as used herein refers to the boundary between silicon adhesion layer 42 and dielectric layer 40 with the exclusion of the portion of the boundary that is physically removed during the planarization operation as is depicted by dashed line 46.

In a preferred embodiment, gate conductive layer 44, which may be a phosphorous-doped amorphous silicon layer, is deposited on silicon adhesion layer 42 by PECVD to a thickness that is preferably in a range from about 5,000 Å to about 7,000 Å. Alternatively, gate conductive layer 44 may include, for example, boron-doped amorphous silicon. Silicon adhesion layer 42 and gate conductive layer 44 are preferably formed to have a combined thickness in a range from about 6,000 Å to about 8,000 Å. Silicon adhesion layer 42 and gate conductive layer 44 will constitute part of the gate electrode structure of the completed field emission device.

Figure 3:
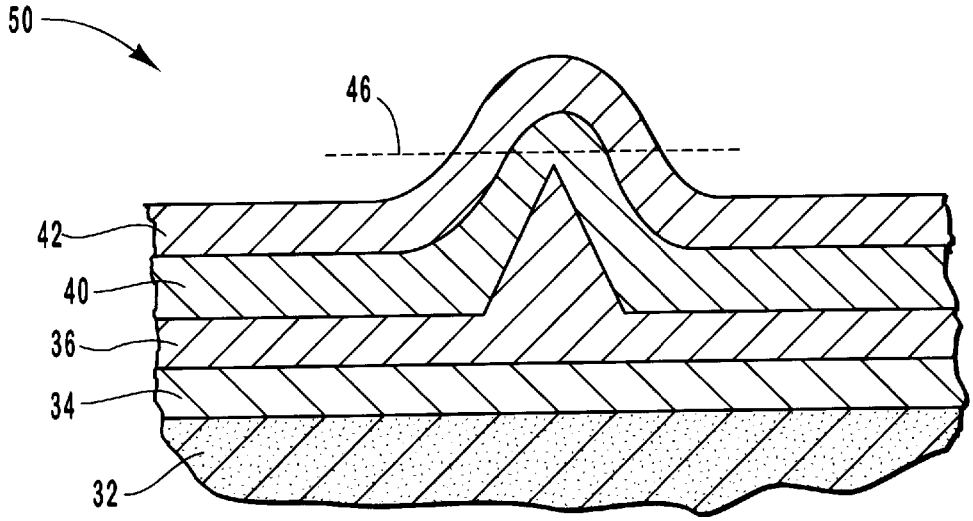
FIG. 3 is a partial cross-section elevation view of a multilayer structure in which a partially formed gate electrode structure includes only a nanocrystalline or microcrystalline layer formed over a silicon dioxide dielectric layer.

Multilayer structure 50 of FIG. 3 illustrates an alternative embodiment of the present invention, in which the thickness of silicon adhesion layer 42 is increased and gate conductive layer 44 as seen in multilayer structure 30 of FIG. 2 is eliminated. Multilayer structures 30 of FIG. 2 and multilayer structure 50 of FIG. 3 both withstand delamination during subsequent chemical-mechanical planarization or other mechanical and non-mechanical planarization operations and provide a completed field emission device that is efficient and operational. However, multilayer structure 30 is preferred because of economic considerations related to the rate at which the layers are be deposited.

PECVD of silicon adhesion layer 42 generally involves a deposition rate that is significantly less than the deposition rate of gate conductive layer 44. For example, it has been found that gate conductive layer 44 may be deposited at a deposition rate in a range from about 800 Å/min to about 1,200 Å/min. In contrast, silicon adhesion layer 42 is typically deposited at a deposition rate that is only in a range from about 150 Å/min to about 200 Å/min. Thus, the average deposition rate of the combination of silicon adhesion layer 42 and gate conductive layer 44 is maximized when silicon adhesion layer 42 is relatively thin, as in multilayer structure 30 of FIG. 2.

Figure 4:
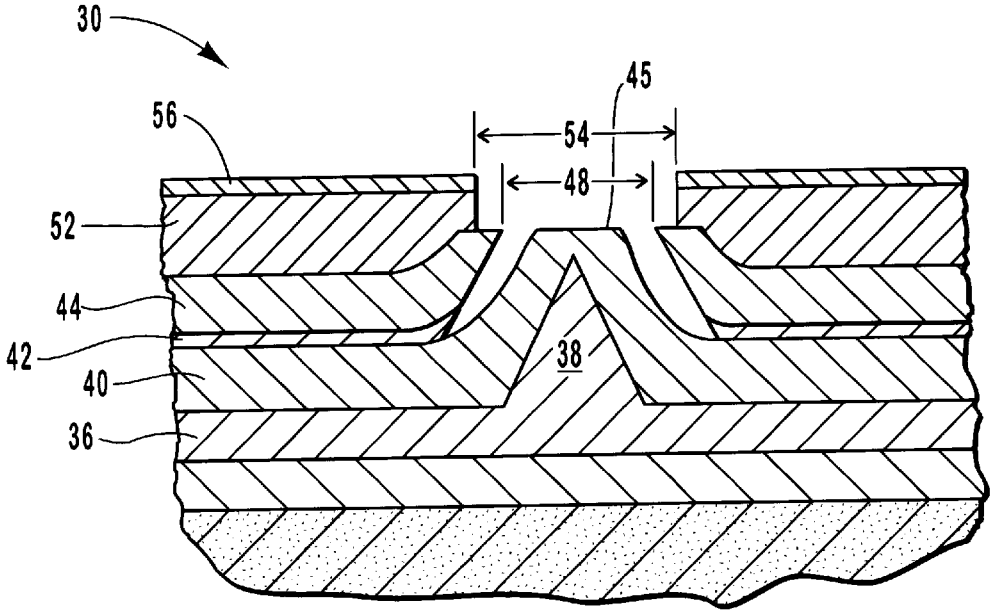
FIG. 4 is a partial cross-section elevation view of the multilayer structure of FIG. 2 in a further step in the process of forming a completed field emission device.

FIGS. 2 and 3 illustrate formation of a substantially pillar surface indicated by dashed line 46. The substantially planar surface is preferably formed by chemical-mechanical planarization, but may be instead provided by any other suitable operations, such as other mechanical planarization procedures or etching. As seen in FIG. 4, chemical-mechanical planarization exposes a surface 45 of dielectric layer 40 positioned over electron emission structure 38. Surface 45 is self-aligned with underlying electron emission structure 38 without requiring manual alignment or other special attention by the technician. The bond between silicon adhesion layer 42 and dielectric layer 40 is sufficiently strong such that delamination or other separation of silicon adhesion layer 42 during mechanical planarization is avoided.

After the foregoing planarization of multilayer structure 30 is conducted, the field emission device may be completed according to any desired and suitable methods. FIG. 4 illustrates multilayer structure 30 of FIG. 2 having undergone several preferred processing steps after chemical-mechanical planarization. For example, silicon adhesion layer 42 and gate conductive layer 44 may be etched or otherwise patterned to form an opening 48 over electron emission structure 38. Opening 48 constitutes a portion of an aperture that will eventually extend to electrically resistive layer 36 and electron emission structure 38. Gate metal layer 52 may then be formed over gate conductive layer 44 and patterned to form therein an opening 54 generally aligned with opening 48 such that surface 45 of dielectric layer 40 over electron emission structure 38 is reexposed. Gate metal layer 52 may include, for example, chromium, aluminum, or alloys thereof. Passivation layer 56, which may consist of silicon nitride, may then be formed over gate metal layer 52 and likewise patterned such that surface 45 remains exposed.

Figure 5:
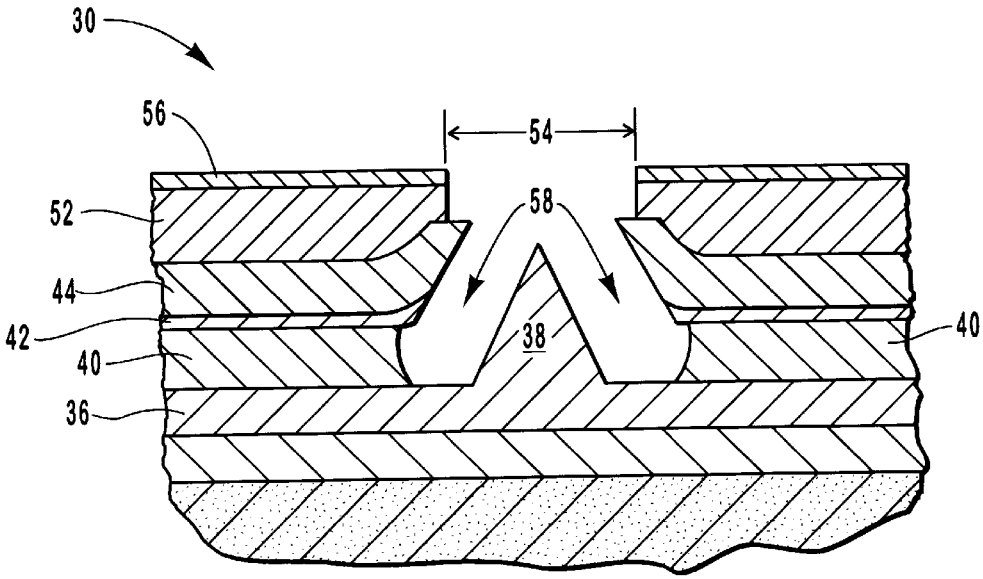
FIG. 5 is a partial cross-section elevation view of the multilayer structure of FIG. 4 in a subsequent step of forming the completed field emission device.

Turning now to FIG. 5, aperture 58 is advantageously formed by conducting an isotropic etch, preferably a wet etch, of dielectric layer 40 through opening 54. Silicon dioxide is removed from dielectric layer 40 such that aperture 58 extends to electrically resistive layer 36. As a result, electron emission structure 38 is exposed and projects into aperture 58. It is understood that aperture 58 extends through dielectric layer 40 and, in the present embodiment, also extends through silicon adhesion layer 42 and gate conductive layer 44, and extends towards gate metal layer 52 and passivation layer 56. It should be noted that aperture 58 is self-aligned with electron emission structure 38 without requiring manual alignment.

Figure 6:
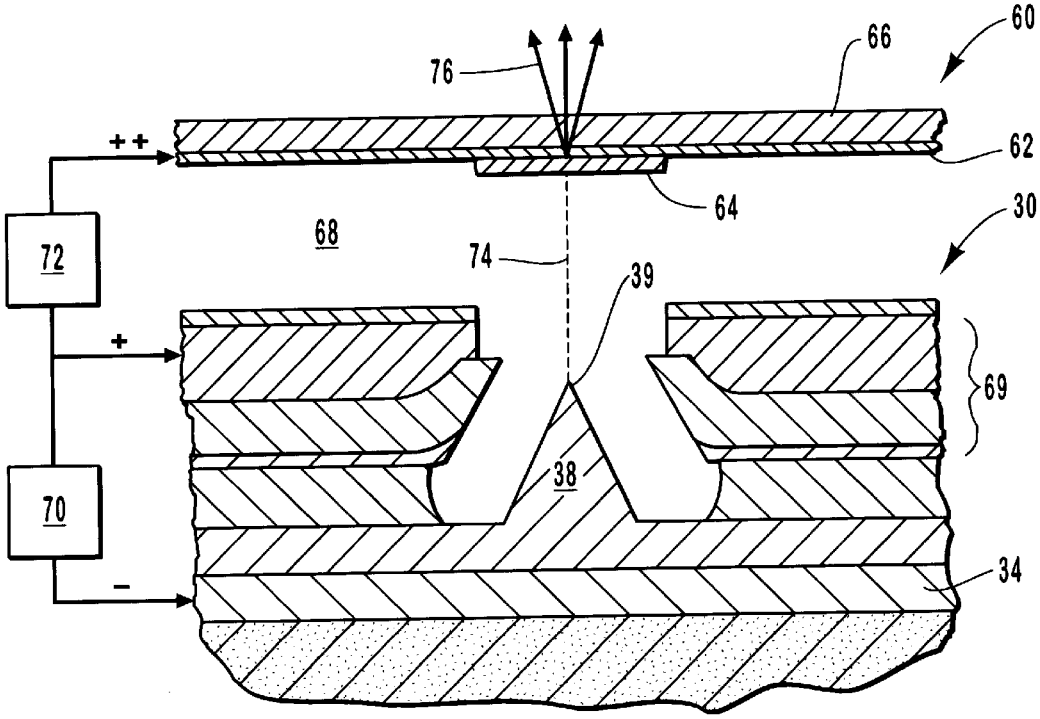
FIG. 6 is a partial cross-section elevation view of the completed field emission device and the display panel in which it is used.

FIG. 6 illustrates a completed field emission device formed according to the invention as used in a flat panel display. Multilayer structure 30 is combined with an anode plate 60 that preferably includes an anode conductive layer 62, a phospholuminescent material 64 and a substantially transparent panel 66. Anode plate 60 is a display panel positioned over electron emission structure 38 and separated therefrom by a vacuum 68. The flat panel display is operated by applying electrical potentials to cathode conductive layer 34, gate electrode structure 69, and anode conductive layer 62. Specifically, a first voltage source 70 generates a negative potential at cathode conductive layer 34 and a positive, but relatively small, potential at gate electrode structure 69. A second voltage source 72 is used to simultaneously generate a relatively high positive electrical potential at anode conductive layer 62.

As a result, an electrical field is applied across electron emission structure 38. The voltage thereof is greater than the localized work function at apex 39 of electron emission structure 38, thereby causing a flow of electrons 74 to be emitted from apex 39. Electrons 74 accelerate toward anode conductive layer 62 and are absorbed into phospholuminescent material 64. Electrons 74 cause atoms within phospholuminescent material 64 to become excited and to emit light 76 that is visible to an observer.

Figure 7:
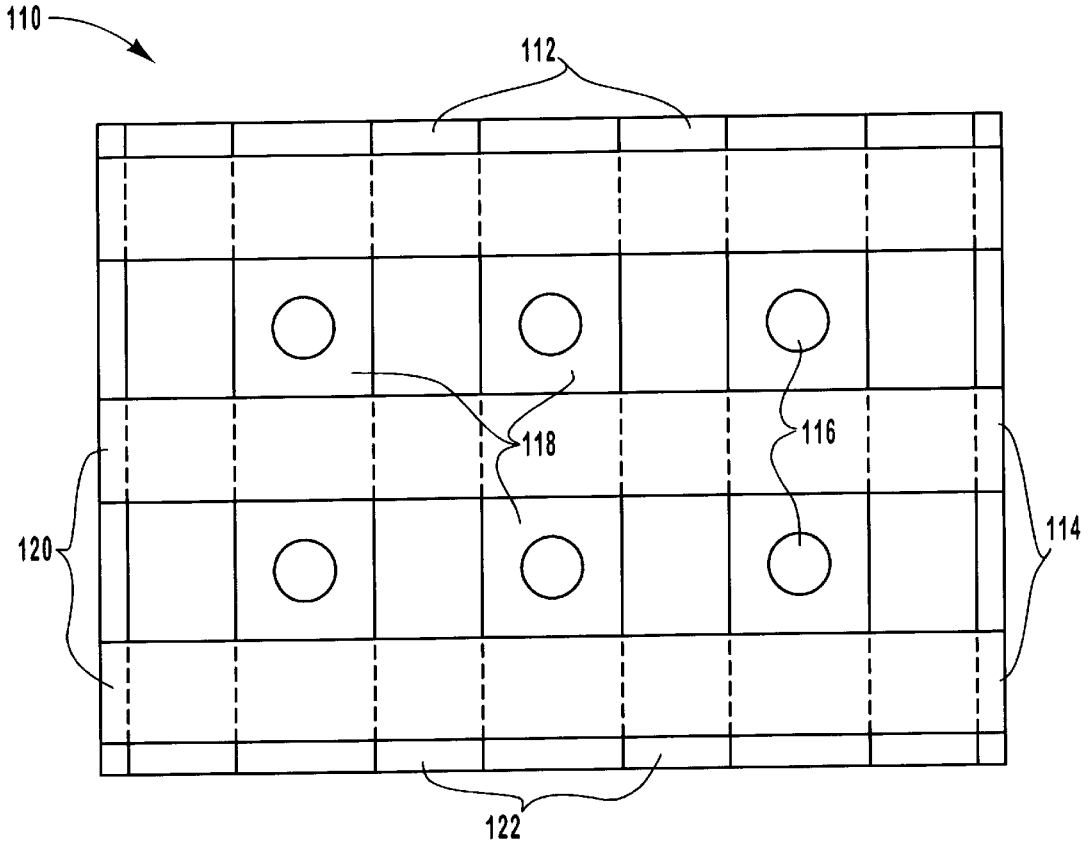
FIG. 7 is a top view of a portion of a flat panel display that includes an array of field emission devices formed according to the invention.

FIG. 7 depicts a portion 110 of a flat panel display having an array of field emission devices distributed over a substrate, and illustrates the relative configuration of a cathode structure 112, a gate electrode structure 114, electron emission structures 116 and apertures 118 that are formed as disclosed herein. For clarity, other elements, such as an overlying anode plate, are not shown. Gate electrode structure 114 is arranged in a plurality of conductive lines 120, while cathode structure 112 is arranged in a plurality of conductive columns 122. The electron emission structures 116 are matrix-addressable, meaning that each has an address consisting of one of the plurality of conductive lines 120 and one of the plurality of conductive columns 122. An electron emission structure may be caused to emit electrons by generating an electrical gradient between the column and line that define the address of the electron emission structure. By coordinating the activation of selected electron emission structures in this manner, a selected visual display may be generated on the flat panel display.

Each of the array of apertures 118 of FIG. 7 surrounds one electron emission structure 116. However, the invention may also be practiced by forming multiple electron emission structures within each aperture 118.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for producing a visual display, said apparatus comprising:

a substrate;

a dielectric layer over said substrate;

a gate electrode structure including a silicon adhesion layer on said dielectric layer, said silicon adhesion layer being substantially composed of a material selected from the group consisting of nanocrystalline silicon and microcrystalline silicon;

an array of apertures, each extending through said silicon adhesion layer and said dielectric layer;

an array of electron emission structures for emitting electrons upon application of an electric field thereto, each of said electron emission structures being positioned over said substrate and within one of said apertures; and a display panel over said array of electron emission devices for emitting light in response to electrons emitted from said electron emission structures.

2. An electron emission apparatus as defined in claim 1, wherein said silicon adhesion layer is substantially composed of undoped silicon.

3. An electron emission apparatus as defined in claim 1, wherein said adhesion layer has a mean grain size in a range from 200 Å to 1,000 Å.

4. An apparatus as defined in claim 1, wherein said display panel includes phospholuminescent material for emitting said light upon being excited by said electrons.

5. An apparatus as defined in claim 1, further comprising a cathode structure under said gate electrode structure.

6. An apparatus as defined in claim 5, wherein:

said gate electrode structure includes a plurality of conductive lines;

said cathode structure includes a plurality of conductive columns; and each of said electron emission structures has an address defined by one conductive column of said plurality of conductive columns and one conductive line of said plurality of conductive lines.

7. An apparatus as defined in claim 1, wherein said substrate comprises glass.

8. An apparatus as defined in claim 7, wherein said glass is soda-lime glass.

9. An electron emission apparatus as defined in claim 1, wherein each said electron emission structure projects away from said substrate and tapers to an apex.

10. An apparatus as defined in claim 1, wherein said display panel comprises phospholuminescent material.

11. An apparatus for producing a visual display, said apparatus comprising:

a substrate;

a dielectric layer over said substrate;

a gate electrode structure including:

silicon adhesion layer on said dielectric layer, said silicon adhesion layer being composed of a material selected from the group consisting of nanocrystalline silicon and microcrystalline silicon; and a gate conductive layer on said silicon adhesion layer, said gate conductive layer including phosphorus-doped amorphous silicon;

an array of apertures, each extending through said silicon adhesion layer, said dielectric layer, and said gate conductive layer;

an array of electron emission structures for emitting electrons upon application of an electric field thereto, each of said electron emission structures being positioned over said substrate and within one of said apertures; and a display panel over said array of electron emission devices for emitting light in response to electrons emitted from said electron emission structures.

12. An electron emission apparatus as defined in claim 11, further comprising an anode plate positioned over both of said gate conductive layer and said array of electron emission structures, said anode plate being separated from both of said gate conductive layer and said array of electron emission structures by a vacuum, said anode plate having:

an anode conductive layer;

a phospholuminescent material; and a transparent panel.

13. An apparatus as defined in claim 12, further comprising:

a cathode conductive layer; and an electrically resistive layer on said cathode conductive layer and under said dielectric layer.

14. An apparatus as defined in claim 13, wherein said cathode conductive layer comprises a metal selected from the group consisting of chromium, aluminum, and alloys thereof.

15. An apparatus as defined in claim 13, wherein said electrically resistive layer comprises boron-doped amorphous silicon.

16. An apparatus for producing a visual display, said apparatus comprising:

a substrate;

a dielectric layer over said substrate;

a gate electrode structure including:

silicon adhesion layer on said dielectric layer, said silicon adhesion layer being composed of a material selected from the group consisting of nanocrystalline silicon and microcrystalline silicon; and a gate conductive layer on said silicon adhesion layer, said gate conductive layer including phosphorus-doped amorphous silicon;

a gate metal layer including a metal selected from the group comprising chromium, aluminum, and alloys thereof, said gate metal layer being positioned on said gate conductive layer;

a passivation layer including silicon nitride, said passivation layer being positioned on said gate metal layer;

an array of apertures, each extending through said silicon adhesion layer, said dielectric layer, and said gate conductive layer;

an array of electron emission structures for emitting electrons upon application of an electric field thereto, each of said electron emission structures being positioned over said substrate and within one of said apertures; and a display panel over said array of electron emission devices for emitting light in response to electrons emitted from said electron emission structures.

17. An apparatus as defined in claim 16, wherein:

said silicon adhesion layer has a thickness in a range from about 500 Å to about 1,500 Å; and said gate conductive layer has a thickness in a range from about 5,000 Å to about 7,000 Å.

18. An electron emission apparatus as defined in claim 16, wherein said silicon adhesion layer is substantially composed of undoped silicon.

19. An electron emission apparatus as defined in claim 16, wherein said adhesion layer has a mean grain size in a range from 200 Å to 1,000 Å.

20. An apparatus as defined in claim 16, wherein said display panel includes phospholuminescent material for emitting said light upon being excited by said electrons.

21. An apparatus as defined in claim 16, further comprising a cathode structure under said gate electrode structure.

22. An apparatus as defined in claim 21, wherein:

said gate electrode structure includes a plurality of conductive lines;

said cathode structure includes a plurality of conductive columns; and each of said electron emission structures has an address defined by one conductive column of said plurality of conductive columns and one conductive line of said plurality of conductive lines.

23. An apparatus as defined in claim 16, wherein said substrate comprises glass.

24. An apparatus as defined in claim 23, wherein said glass is soda-lime glass.

25. An electron emission apparatus as defined in claim 16, wherein each said electron emission structure projects away from said substrate and tapers to an apex.

26. An apparatus as defined in claim 16, wherein said display panel comprises phospholuminescent material.

* * * * *

UNITED STATES PATENT AND TRADEMARK OFFICE

CERTIFICATE OF CORRECTION

PATENT NO. : 6,137,214
DATED : October 24, 2000
INVENTOR(S) : Kanwal K. Raina

It is certified that error appears in the above-identified patent and that said Letters Patent is hereby corrected as shown below:

Column 3,
Line 1, after "strong" change "tot" to -- to --

Column 6,
Line 14, after "at relatively" change "love" to -- low --

Column 8,
Line 4, before "deposited" delete "be"
Line 17, after "substantially" change "pillar" to -- planar --

Signed and Sealed this

Eighteenth Day of December, 2001

*Attest:*

*Attesting Officer*

JAMES E. ROGAN
*Director of the United States Patent and Trademark Office*